United States Patent [19]

Zaita et al.

[11] 4,445,466

[45] May 1, 1984

[54] CARBURETION SYSTEM FOR V-TYPE INTERNAL COMBUSTION ENGINES

[75] Inventors: Katsuyuki Zaita, Kawagoe; Suminari Iwao, Tokyo, both of Japan

[73] Assignee: Honda Giken Kogyo Kabushiki Kaisha, Tokyo, Japan

[21] Appl. No.: 397,368

[22] Filed: Jul. 12, 1982

[30] Foreign Application Priority Data

| | | | |
|---|---|---|---|
| Jul. 10, 1981 | [JP] | Japan | 56-103345[U] |
| Aug. 20, 1981 | [JP] | Japan | 56-130611 |
| Dec. 28, 1981 | [JP] | Japan | 56-213220 |

[51] Int. Cl.[3] ..... F02B 75/20

[52] U.S. Cl. ..... 123/59 PC; 123/579; 123/580; 123/52 MV

[58] Field of Search ..... 123/59 PC, 579, 52 MV, 123/55 V, 55 VE, 55 VF, 580

[56] References Cited

U.S. PATENT DOCUMENTS

| | | | |
|---|---|---|---|
| 3,142,289 | 7/1964 | Platner et al. | 123/55 VE |

FOREIGN PATENT DOCUMENTS

| | | | |
|---|---|---|---|
| 663379 | 5/1963 | Canada | 123/52 MV |
| 689096 | 6/1964 | Canada | 123/52 MV |
| 55-161948 | 12/1980 | Japan | 123/580 |
| 56-72229 | 6/1981 | Japan | 123/579 |

*Primary Examiner*—E. Rollins Cross
*Attorney, Agent, or Firm*—Armstrong, Nikaido, Marmelstein & Kubovcik

[57] ABSTRACT

A carburetion system for V-type internal combustion engine having a first carburetor and a second carburetor disposed in a space between a first cylinder and a second cylinder arranged in a form like V and adapted to supply air-fuel mixture to respective cylinders independently, improved to have a compact structure and superior intake charging efficiency with capability of substantially uniformly supplying the mixture during acceleration and deceleration of the vehicle. The carburetors have intake barrels defining therein intake passages communicating with the associated cylinders. The intake barrels are disposed substantially at right angles to the axes of the associated cylinders and in the close proximity of each other in such a manner as to partially cross each other. A pair of float chambers are disposed between the intake barrels below the point of crossing of the intake barrels. A main fuel system and a slow fuel system for introducing the fuel from each float chamber have a main fuel pipe and a slow fuel pipe which extend into the portions of the float chamber below the fuel surface. The axes of the main fuel pipe and slow fuel pipe are inclined to the axis of the intake barrel. The slow fuel pipe is arranged such that its axis intersects the fuel surface at a point as close as possible to the center of the fuel surface. Each float chamber accommodates therein a float which cooperates with a float valve in maintaining a constant fuel surface level in the float chamber. The float is arranged in such a manner as to move in parallel with the axis of the slow fuel pipe in response to a change in the level of the fuel surface in the float chamber.

13 Claims, 5 Drawing Figures

CARBURETION SYSTEM FOR V-TYPE INTERNAL COMBUSTION ENGINES

BACKGROUND OF THE INVENTION

1. Field of the Invention

The present invention relates to a carburetion system for V-type internal combustion engine for vehicles having a first cylinder and a second cylinder which are arranged in a form like V and, more particularly, to a carburetion system having a first carburetor and a second carburetor which are arranged in the space between the first and second cylinders and constitute intake system for these cylinders.

2. Description of the Prior Art

The carburetion system of the kind described above is advantageous from the view point of reduction in the whole size of the engine because it permits the mounting of the intake systems for the first and second cylinders in the space between these cylinders.

The carburetion system of this type proposed hitherto, however, suffers problems due to the fact that the space mentioned above is comparatively small. Namely, in the conventional system of the kind described, the intake passages of the intake systems are wound or curved to increase the flow resistance against the intake air. In some cases, the air introduction ports of the carburetors are so spaced from each other as to make it difficult to connect these ports to a common air cleaner.

SUMMARY OF THE INVENTION

Accordingly, an object of the invention is to provide a simple and compact carburetion system of the kind described, thereby to overcome the abovedescribed problems of the prior art.

Another object of the invention is to provide a carburetion system of the kind described, which is improved to eliminate any fluctuation of air-fuel ratio of the mixture supplied to the cylinders, attributable to an inclination of fuel surface in the float chamber caused by acceleration or deceleration of the vehicle.

Still another object of the invention is to provide a carburetion system of the kind described, in which the intake barrels of a first carburetor and a second carburetor, as well as a float chamber of a required volume, are mounted in a compact manner in a narrow space between a first cylinder and a second cylinder of a V-type internal combustion engine, in such a manner that the winding of the intake passages between the inlets of the intake barrels and the intake valves of the cylinders is minimized while preserving necessary lengths of these intake passages, and that the charging efficiency of the engine is improved by an efficient use of inertia of the intake air.

The above and other objects, features and advantages of the invention will become apparent from the following description of a preferred embodiment when taken in conjunction with the accompanying drawings.

DESCRIPTION OF THE PREFERRED EMBODIMENT

A preferred embodiment of the invention will be described hereinunder with reference to the accompanying drawings.

Figure 1:
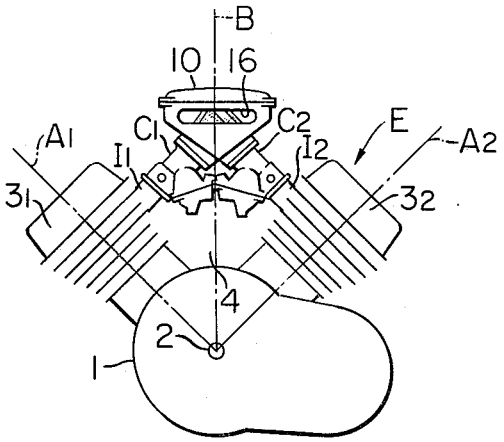
FIG. 1 is a side elevational view of a V-type internal combustion engine equipped with a carburetion system in accordance with the invention.

Referring first to FIG. 1, a motorcycle mounts a V-type internal combustion engine represented by E and having a crank case 1 supporting a crank shaft 2 extending transversely of the frame of the motorcycle. The engine E has two cylinders: namely, a first cylinder $3_1$ and a second cylinder $3_2$ which are arranged longitudinally of the frame of the motorcycle in a form like V. A first carburetor $C_1$ and a second carburetor $C_2$ which constitute respective intake systems for the first and second cylinders $3_1$ and $3_2$ are arranged in the V-shaped space formed between two cylinders $3_1$ and $3_2$. Although the engine E is illustrated to have two cylinders and two carburetors, the invention does not exclude such a case where two or more first cylinders, as well as two or more second cylinders, are arranged in the axial direction of the crank case 2 together with corresponding carburetors.

Neglecting the offset between two cylinders $3_1$ and $3_2$ in the axial direction of the crank shaft 2, the first carburetor $C_1$ and the second carburetor $C_2$ are arranged in symmetry with respect to a bisector line B of the angle formed between the axes $A_1$ and $A_2$ of two cylinders $3_1$ and $3_2$.

Figure 2:
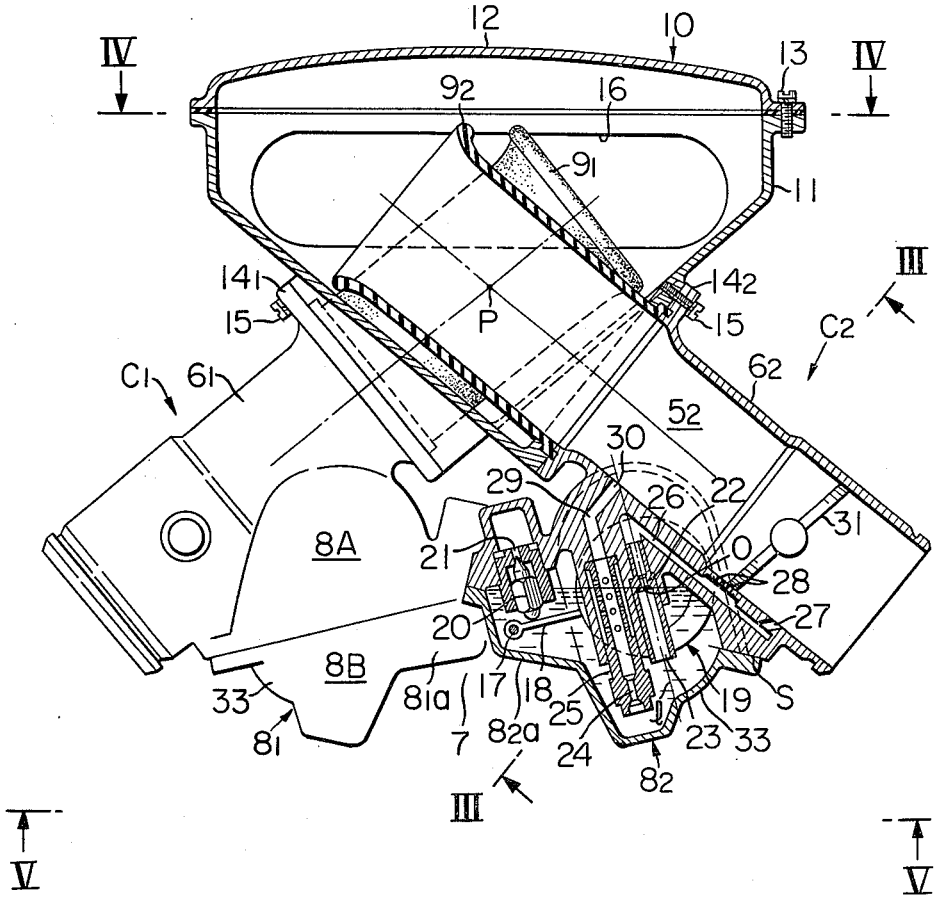
FIG. 2 is an enlarged partial sectional side elevational view of the carburetion system as shown in FIG. 1.
Figure 4:
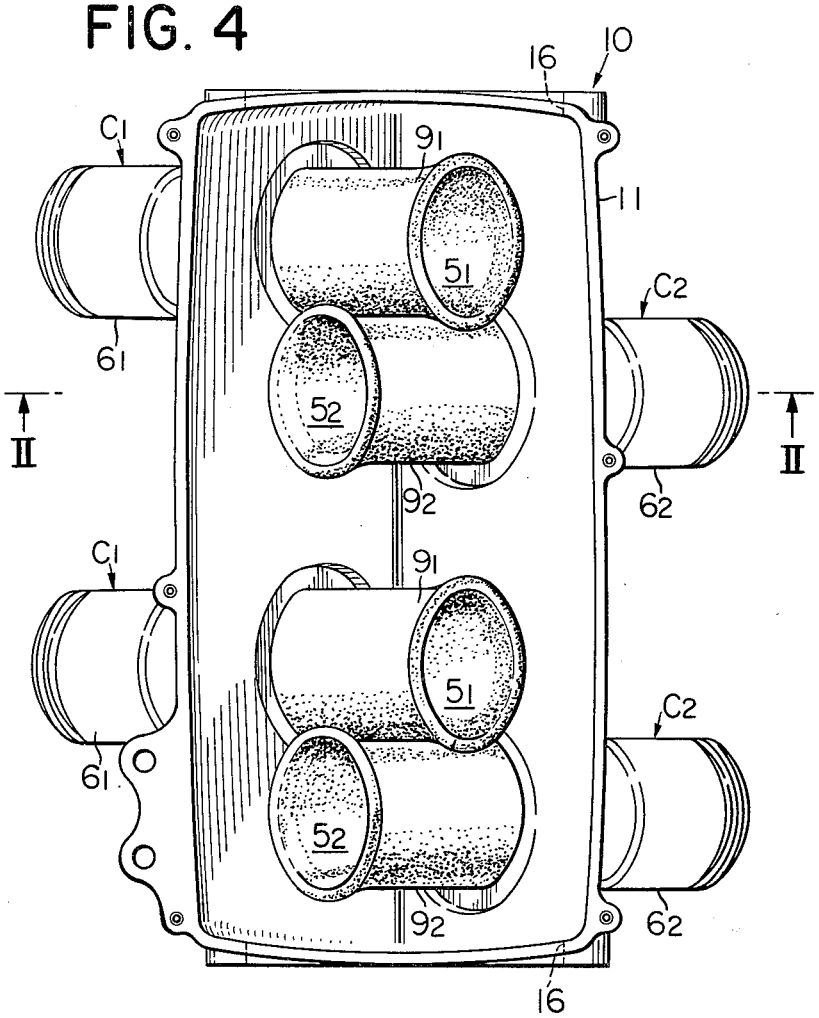
FIG. 4 is a sectional view taken along the line IV—IV of FIG. 2.
Figure 5:
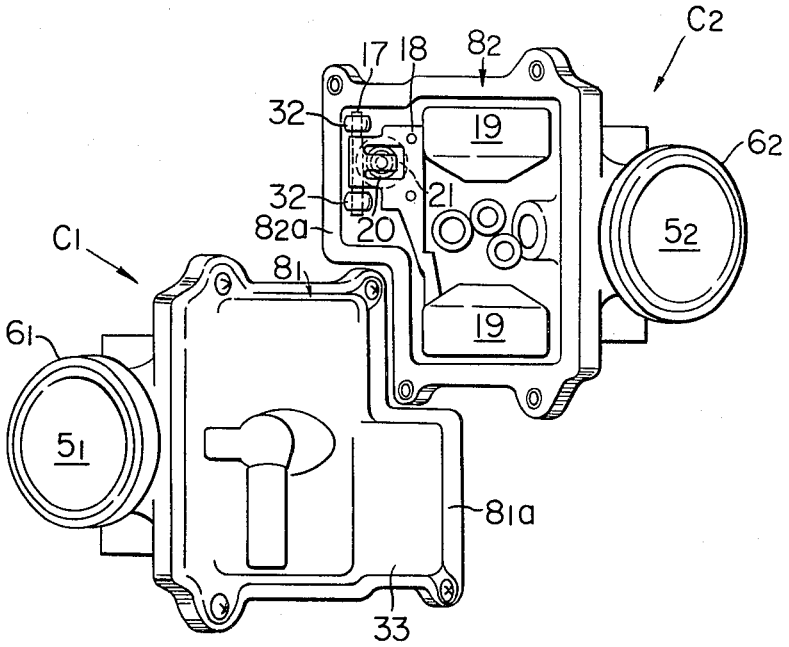
FIG. 5 is a sectional view taken along the line V—V of FIG. 2.

As will be seen from FIGS. 2 and 4, the first carburetor $C_1$ and the second carburetor $C_2$ have intake barrels $6_1$ and $6_2$ defining therein respective intake passages $5_1$ and $5_2$. The intake barrels $6_1$ and $6_2$ extend substantially at a right angle to the axes $A_1$ and $A_2$ of the first and second cylinders $3_1$ and $3_2$, respectively. The adjacent intake barrels $6_1$ and $6_2$ are inclined to the horizontal plane and made to approach each other. Preferably, these intake barrels are arranged to contact each other and to intersect each other at a predetermined angle as illustrated. The intake barrels $6_1$ and $6_2$ are connected to corresponding cylinders $3_1$ and $3_2$ through heat insulating sleeves $I_1$ and $I_2$ made of a rubber or the like material. The point P of the intersection of two intake barrels $6_1$ and $6_2$ is offset from the center of both intake barrels towards the inlet sides of the same, so that an ample space 7 is formed between the portions of the intake barrels $6_1$,$6_2$ below the point P of intersection. Float chambers $8_1$,$8_2$ annexed to the carburetors $C_1$ and $C_2$ are disposed in this space 7. Furthermore, as shown in FIGS. 2 and 4, the float chambers $8_1$ and $8_2$ are provided with extension chambers $8_{1a}$,$8_{2a}$ which are projected therefrom towards the other float chamber, so that each float chamber can have sufficient volumes.

Each of the float chambers $8_1$ and $8_2$ is composed of a float chamber body 8A formed as a unit with corresponding one of the intake barrels $6_1$ and $6_2$ and opened at its lower side, and a lower cover 8B adapted to be jointed to the lower side of the float chamber body 8A. In each float chamber, the jointing surface S between the float chamber body 8A and the lower cover 8B is inclined to the horizontal plane at an angle smaller than the angle of inclination of the intake barrel $6_1$ or $6_2$.

Figure 3:
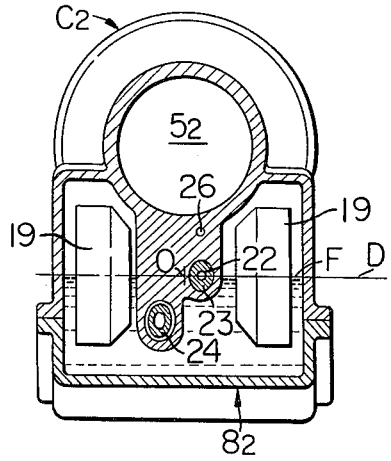
FIG. 3 is a sectional view taken along the line III—III of FIG. 2.

Each of the float chambers $8_1$ and $8_2$ accommodates therein a pair of float 19 which are connected to each other through a rockable arm 18. The rockable arm 18 is supported by a pivot shaft 17 for free rocking motion in a vertical plane. The pivot shaft 17 is supported by bearings 32 formed integrally with the float chamber body 8A constituting a part of the extension chamber $8_{1a}$ ($8_{2a}$) and extends in parallel with the crank shaft 2. In each of the extension chambers $8_{1a}$ and $8_{2a}$, a fuel inlet port 21 opens in the lower face of the float chamber body 8A. A float valve 20 is operatively connected to the rockable arm 18 and is adapted to open and close the fuel inlet port 21. Therefore, as the fuel level in each float chamber comes down due to consumption of fuel, the float is lowered to permit the float valve 20 to open, so that fuel is supplied to the float chamber from a fuel tank (not shown) through the fuel inlet port 21, thereby to recover the ordinary fuel level in each float chamber. In FIG. 3, the fuel surface is represented by a symbol F while a symbol O represents the center of the oil surface, i.e. the point the level of which is unchanged even when the oil surface F is inclined.

Each of the floats 19 constituting a pair has a cylindrical, frusto-conical or a composite form of a cylinder and a frusto-cone having an axis parallel to the axis of the crank shaft 2. The design is such that the draft line passes the center of each float when the latter floats on the fuel surface F. The floats 19 are arranged such that the center O of the fuel surface takes the mid position therebetween. In consequence, the floats 19 are never moved up and down by a mere inclination of the fuel surface F to the left and right but move only in response to the substantial change in the level of the fuel surface F.

Each of the float chambers $8_1$ and $8_2$ is provided with a slow fuel pipe 23 having a slow jet 22 and a main fuel pipe 25 having a main jet 24. These fuel pipes 23 and 25 are inclined to the axis of corresponding one of the intake passages $5_1$ and $5_2$, and are mounted on the float chamber body 8A.

More specifically, the slow fuel pipe 23 is located such that its axis l approaches as much as possible the center O of the fuel surface, while the main fuel pipe 25 extends in parallel with the slow fuel pipe 23 such that its axis approaches the center O as much as possible. Therefore, the floats 19 move at the portion near the center O of the fuel level in parallel with the axis of the slow fuel pipe in response to the change in the fuel surface level. The slow fuel pipes 23 are connected at their upper ends of idle ports 27 and bypass ports 28 opening in respective intake passages $5_1$ and $5_2$ through respective fuel passages 26. On the other hand, the main fuel pipes 25 are connected at their upper ends through respective fuel passages 29 to main nozzles 30 opening to respective intake passages $5_1$,$5_2$. The main nozzles 30 are disposed substantially perpendicularly to the intake passages $5_1$ and $5_2$. A reference numeral 31 designates a throttle valve disposed in each of the intake passages $5_1$ and $5_2$.

As will be seen from FIGS. 2 and 3, the portions of the intake barrels $6_1$ and $6_2$ where those barrels intersect each other are air horns $9_1$ and $9_2$ made of a rubber. These air horns $9_1$ and $9_2$ are housed by a common intake box 10 having a substantially triangular form and extending in parallel with the crank shaft 2. The intake box 10 is composed of a housing 11 opened at its upper end and a lid 12 adapted to be secured to the upper side of the housing 11 by means of screws 13 so as to close the upper end opening. Mounting flanges $14_1$ and $14_2$ provided at intermediate portions of the intake barrels $6_1$ and $6_2$ are secured by means of screws 15 to the housing 11. Therefore, all carburetors $C_1$ and $C_2$ are connected integrally through the common intake box 10. The housing 11 is provided in its left and right side walls with air inlet openings 16 to the inlet sides of which attached are air cleaners (not shown).

In assembling, the carburetors $C_1$ and $C_2$ are connected at their mounting flanges $14_1$,$14_2$ to the housing 11 and air horns $9_1$,$9_2$ are fitted to the portions of the barrels within the housing 11. Finally, the lid 12 is attached and fixed. It will be seen that this arrangement permits an easy assembling of crossing portions of the intake barrels $6_1$ and $6_2$.

During the idling or slow speed running of the engine E in which the throttle valves 31,31 of both carburetors $C_1$ and $C_2$ are held at the idle opening or other small opening, the fuel stored in the float chambers $8_1$ and $8_2$ is sucked up through the slow fuel pipes 23 and 23 and, after being metered in the slow jets 22,22, introduced into the intake passages $5_1$ and $5_2$ through the idle ports 27,27 or bypass ports 28,28 via the fuel passages 26,26. The fuel is then mixed with sucked air to form air-fuel mixtures of a thickness suited for the idling or low-speed running of the engine. The mixtures are then induced into respective cylinders $3_1$ and $3_2$.

As the throttle valves 31,31 are opened to a large opening degree to accelerate the engine to a high speed, the fuel is sucked up from the float chambers $8_1$,$8_2$ through respective main fuel pipes 25,25 and, after a metering through the main jets 24,24, introduced into the intake passages $5_1$, $5_2$ through main nozzles 30,30 via the fuel passages 29,29 so as to be mixed with the intake air to form air-fuel mixtures of a thickness suited for the high speed running of the engine. The mixtures are then induced into respective cylinders $3_1$,$3_2$.

As has been described, according to the invention, the first carburetor $C_1$ and the second carburetor $C_2$ are disposed between the first cylinder and the second cylinder arranged in a form like V, in such a manner that their intake barrels cross the axes of corresponding cylinders substantially at right angles, respectively, and that the intake barrels approach and cross each other. According to this arrangement, it is possible to mount the first and second carburetors without bending the intake barrels of predetermined lengths, even in the restricted space between the first and second cylinders. It is, therefore, possible to reduce the flow resistance against the intake air and, hence, to make full use of the inertia of the intake air, thereby to increase the output power of the engine.

In addition, since the intake barrels of the first and second carburetors cross each other, the inlet openings of both intake barrels open in the opposite directions so that the undesirable mutual intake interference between both carburetors is avoided in spite of the mounting of intake barrels in the close proximity of each other. Thus, the cylinders can stably receive the air-fuel mixture from respective carburetors.

Furthermore, the mounting of both intake barrel in the close proximity of each other minimizes the overall breadth of the carburetion system as a whole to permit the mounting of the latter in a compact manner within the limited space between two cylinders.

Moreover, it is possible to provide all carburetors with a common intake space, so that the layout and installation of the air cleaner is facilitated.

It is also to be noted that, since the float chambers of the first and second carburetors are disposed between the portions of the intake barrels below the point of crossing of both intake barrels, the space between both intake barrels can be utilized efficiently to further contribute to the realization of compact arrangement of the system as a whole. At the same time, since each float chamber is composed of a float chamber body integral with the lower part of each intake barrel and a lower lid adapted to close the lower end opening of the float chamber body, the joint surface between the float chamber body and the lower lid being inclined to the horizontal plane at an angle smaller than the angle of inclination of the intake barrel, it is possible to obtain a sufficiently large cross-sectional area of the float chamber regardless of the inclination of each intake barrel. This permits an easy mounting of the float valve and so forth and makes it possible to maintain the fuel storage volume of the float chamber to the minimum required value.

Furthermore, since the float chambers annexed to the first and the second carburetors are provided with extension chambers projected therefrom towards the lateral side of the other float chamber, it is possible to obtain the required volumes of the float chambers without mutual interference between the two float chambers, although they are arranged in a limited space between the cylinders, by suitably selecting the amount of extension of the extension chambers. Since both float chambers are provided at their one sides with the extension chambers, it is possible to equalize the shape and size of the first and second carburetors including the float chambers and the intake barrels, to permit the common use of the parts, thereby to contribute to the improvement in the mass-productivity and reduction in the production cost.

In the described embodiment, the support shaft for vertically movably supporting the floats in each float chamber is disposed in the extension chamber of the flat chamber. It is, therefore, possible to preserve a sufficiently large space for accommodation of the floats in each float chamber, without being interfered by the support shaft. This arrangement naturally permits the disposition of fuel inlet ports to both float chambers in the vicinity of each other, so that the piping of fuel pipe to both float chambers is very much facilitated.

Finally, it is to be noted that, since the slow fuel port is disposed to pass the substantial centeral part of the fuel surface in the float chamber formed just under each intake barrel, no apparent change of the fuel level takes place at the position of the slow fuel pipe even when the fuel surface is inclined back and forth due to acceleration and deceleration of the vehicle. Therefore, no change takes place in the rate of sucking of fuel through the slow fuel pipe, which rate determining the air-fuel ratio of the mixture of the slow system. In consequence, no fluctuation takes place in the slow air-fuel mixture supplied to each cylinder. In addition, the switching between the slow fuel system and main fuel system is achieved in a continuous manner, so that it is possible to obtain good acceleration and deceleration performances of the engine.

What is claimed is:

1. In a carburetion system for a V-type internal combustion engine having a first carburetor and a second carburetor disposed in a space between a first cylinder and a second cylinder arranged in a form like V and adapted for supplying air-fuel mixture to respective cylinders independently, the improvement wherein said carburetors have intake barrels which define there intake passages communicating with the associated cylinders, said intake barrels being disposed in the close proximity of each other and extend substantially at right angle to the axes of the associated cylinder into a common intake box in which inlet opening side portions of the intake barrels cross each other.

2. A carburetion system according to claim 1, wherein said carburetors are provided with float chambers which are disposed between said intake barrels below the point of crossing of those barrels.

3. In a carburetion system for a V-type internal combustion engine having a first carburetor and a second carburetor disposed in a space between a first cylinder and a second cylinder arranged in a form like V and adapted for supplying air-fuel mixture to respective cylinders independently, the improvements wherein said carburetors have intake barrels which define therein intake passages communicating with the associated cylinders, said intake barrels being disposed in close proximity of each other to cross each other and extended substantially at right angles to the axes of the associated cylinders; and each of said carburetors has a float disposed in each float chamber and movable up and down following the change in the level of fuel surface in said float chamber, a float valve adapted to be operated by said float so as to open and close to maintain the fuel surface in said float chamber at a constant level, and a main fuel passage and a slow fuel passage for introducing the fuel from said float chamber to the associated intake passage, said main fuel passage and said slow fuel passage respectively including a main fuel pipe and a slow fuel pipe extending into the portions of said float chamber below the level of said fuel surface, said slow fuel pipe having an axis inclined to the axis of said cylinder, said float being movable in parallel with said axis of said slow fuel pipe in response to the change in the level of fuel surface in said float chamber.

4. A carburetion system according to claim 3, wherein said axis of said slow fuel pipe intersects the fuel surface in said float chamber at a point as close as possible to the center of said fuel surface.

5. A carburetion system according to claim 4, wherein said main fuel pipe is disposed in parallel with said slow fuel pipe and as close as possible to said center of said fuel surface.

6. A carburetion system according to claim 5, wherein said main fuel passage has a main nozzle opening to the associated intake passage and having an axis perpendicular to the axis of said intake passage.

7. A carburetion system according to claim 4, wherein said main fuel pipe is disposed in parallel with said slow fuel pipe and as close as possible to the center of the associated fuel surface.

8. A carburetion system according to claim 7, wherein said main fuel passage has a main nozzle opening to said intake passage and having an axis perpendicular to the axis of said intake passage.

9. A carburetion system according to claim 3, wherein said float chamber has a float chamber body formed as a unit with the lower part of said intake barrel and opened at its lower side, and a lower lid jointed to the lower side of said float chamber body, the juncture surface between said float chamber body and said lower lid being inclined to the horizontal plane at an angle smaller than the inclination angle of said intake barrel.

10. A carburetion system according to claim 9, wherein said slow fuel pipe is disposed such that its axis intersects the fuel surface in said float chamber at a point as close as possible to the center of said fuel surface.

11. A carburetion system according to claim 3, wherein said float chambers partially cross each other.

12. A carburetion system according to claim 11, wherein each of said float chambers has an extension chamber extended towards the lateral side of the other float chamber.

13. A carburetion system according to claim 12, wherein a support shaft for supporting said float vertically movably is provided on said extension chamber of each float chamber.

* * * * *